US006044657A

United States Patent [19]

Nakanuma et al.

[11] Patent Number: 6,044,657

[45] Date of Patent: Apr. 4, 2000

[54] OUTDOOR UNIT OF SEPARATE TYPE AIR CONDITIONER

[76] Inventors: Mitsuo Nakanuma, 1842, Shimokomazuki, Hino-cho, Gamou-gun, Shiga, 529-1633; Koji Hatano, 3-2-44, Sato, Otsu, Shiga, 520-2276, both of Japan

[21] Appl. No.: 09/171,475

[22] PCT Filed: Feb. 17, 1998

[86] PCT No.: PCT/JP98/00652

§ 371 Date: Nov. 16, 1998

§ 102(e) Date: Nov. 16, 1998

[87] PCT Pub. No.: WO98/36224

PCT Pub. Date: Aug. 20, 1998

[30] Foreign Application Priority Data

Feb. 18, 1997 [JP] Japan ..... 9-033721

[51] Int. Cl.[7] ..... F25D 23/12

[52] U.S. Cl. ..... 62/259.1; 62/298

[58] Field of Search ..... 62/259.1, 262, 62/298; 16/110 R, 124

[56] References Cited

U.S. PATENT DOCUMENTS 1,489,803 4/1924 Vance .
1,900,741 3/1933 Slagel .
2,039,574 5/1936 Wenderoth .

FOREIGN PATENT DOCUMENTS 56-153765 4/1980 Japan .
59-185572 12/1984 Japan .
61-189104 11/1986 Japan .
63-36792 3/1988 Japan .
3-286793 12/1991 Japan .
7-301434 11/1995 Japan .

*Primary Examiner*—Henry Bennett
*Assistant Examiner*—Melvin Jones
*Attorney, Agent, or Firm*—Ratner & Prestia

[57] ABSTRACT

An outdoor unit main body is provided with handles optimum for conveying. Above the housing of the outdoor unit main body, a ceiling cover forming a part of the housing box is provided, and handles extended in the outer direction from the sides of the housing of the outdoor unit main body are provided at both side surfaces of the ceiling cover. Inside of the handle is a double structure consisting of right and left spaces by means of a partition wall, and the first space is a space for inserting the fingers of the carrier when conveying the outdoor unit main body, and a sufficient space for inserting up to the second joint of the fingers is assured. In the second space, plural ribs are disposed at specific intervals, and the leading end of each rib is formed in a semicircular shape so that the finger may settle in naturally, and also each rib has a specific angle for the ease of gripping.

17 Claims, 11 Drawing Sheets

OUTDOOR UNIT OF SEPARATE TYPE AIR CONDITIONER

This application is a U.S. national phase application of PCT international application PCT/JP98/00652.

TECHNICAL FIELD

The present invention relates to an outdoor unit of a separate type air conditioner consisting of an indoor unit and an outdoor unit which are installed separately, and more particularly to handles for conveying the outdoor unit.

BACKGROUND ART

This kind of art is known hitherto, for example, as disclosed in Japanese Laid-open Patent No. 7-301434. This prior art is described below by referring to a perspective view of outdoor unit in FIG. 18 and a sectional view in FIG. 19 showing essential parts of the outdoor unit of FIG. 18.

As shown in FIG. 18, in one side plate 2*a* of an outdoor unit main body 1, handle fitting holes 3 of same shape serving also as air suction ports for heat exchange are provided in plural stages, and one handle 4 of concave and box shape opened at the front side can be fitted into handle fitting holes 3, so that the mounting position of the handle 4 can be varied appropriately.

Other handle 6 is a fixed handle, and, like the first handle 4, it is a handle of concave and box shape opened at the front side, which is fitted into handle fitting holes, not shown, provided similarly in a front plate 5 of the outdoor unit main body 1, or in other side plate 2*b* at the opposite side of the side plate 2*a* of the outdoor unit main body 1.

In such constitution, by properly changing the position of the handle 4 fitted at the side of air suction ports 3 for heat exchange, it is easier to convey or install.

In the conventional constitution, however, one handle 4 is fitted into the handle fitting holes 3 provided in one side plate 2*a* of the main body 1, and the other handle 6 is a fixed handle, which is fitted to the front plate 5 of the outdoor unit main body 1, and the two handles 4, 6 are manufactured as different parts.

Moreover, as shown in FIG. 19, the handle 4 of concave and box shape opened at the front side is fitted to the side plate 2*a* of the outdoor unit main body 1 so as to project inside, and therefore due to the presence of a heat exchanger 7 disposed inside the outdoor unit main body 1 and others, the inside projecting dimension r is limited, and the dimension of the inner width (depth) r' of the handle 4 is available only for about a first joint of a finger F of a hand. To extend the dimension r', the dimension r must be kept sufficiently, which results in large overall dimensions of the outdoor unit main body 1.

At the fixed handle 6 side, similarly, since the refrigeration cycle parts, that is, electric parts composing the compressor, piping and electric circuits are disposed inside the outdoor unit main body 1, the degree of freedom of design of the handle 6 is limited in order to avoid contact with other parts, and it is far from an optimum handle shape.

Besides, since one of the two handles 4, 6 is fixed, the setting positions cannot be changed, and sufficient effect is not obtained for the ease of conveying.

The invention is intended to solve such problems of the prior art, and it is hence an object thereof to present an outdoor unit of separate type air conditioner having handles ideal for conveying.

SUMMARY OF THE INVENTION

To solve the problems, in the outdoor unit of the separate type air conditioner of the invention, a ceiling cover forming a part of a housing is provided in the upper part of the housing of box shape of the outdoor unit main body, handles are fitted to both side surfaces of this ceiling cover, with a degree of freedom of design by extending in the outer direction from the side surfaces of the housing, and the structure of the handle inside of the main body is a double structure in an approximately m-shaped longitudinal section, by disposing a space having enough depth for allowing the fingers of a carrier who conveys the outdoor unit main body to get in by the half of the length or more, or further disposing a space having plural ribs for lessening the pressure load to the fingers or for reinforcing the handle. In this constitution, it is effective to keep space for applying sufficiently up to the second joint of the finger of the carrier when conveying, and to lessen load to the fingers of the hand, prevent damage, and keep strength of the handle. Moreover, by constituting to have a certain angle in the ribs according to fingers for the ease of gripping, it is easier to convey by the carrier, and by forming the ceiling cover integrally with the handles, the number of parts can be curtailed.

BEST MODE OF CARRYING OUT THE INVENTION

Figure 1:
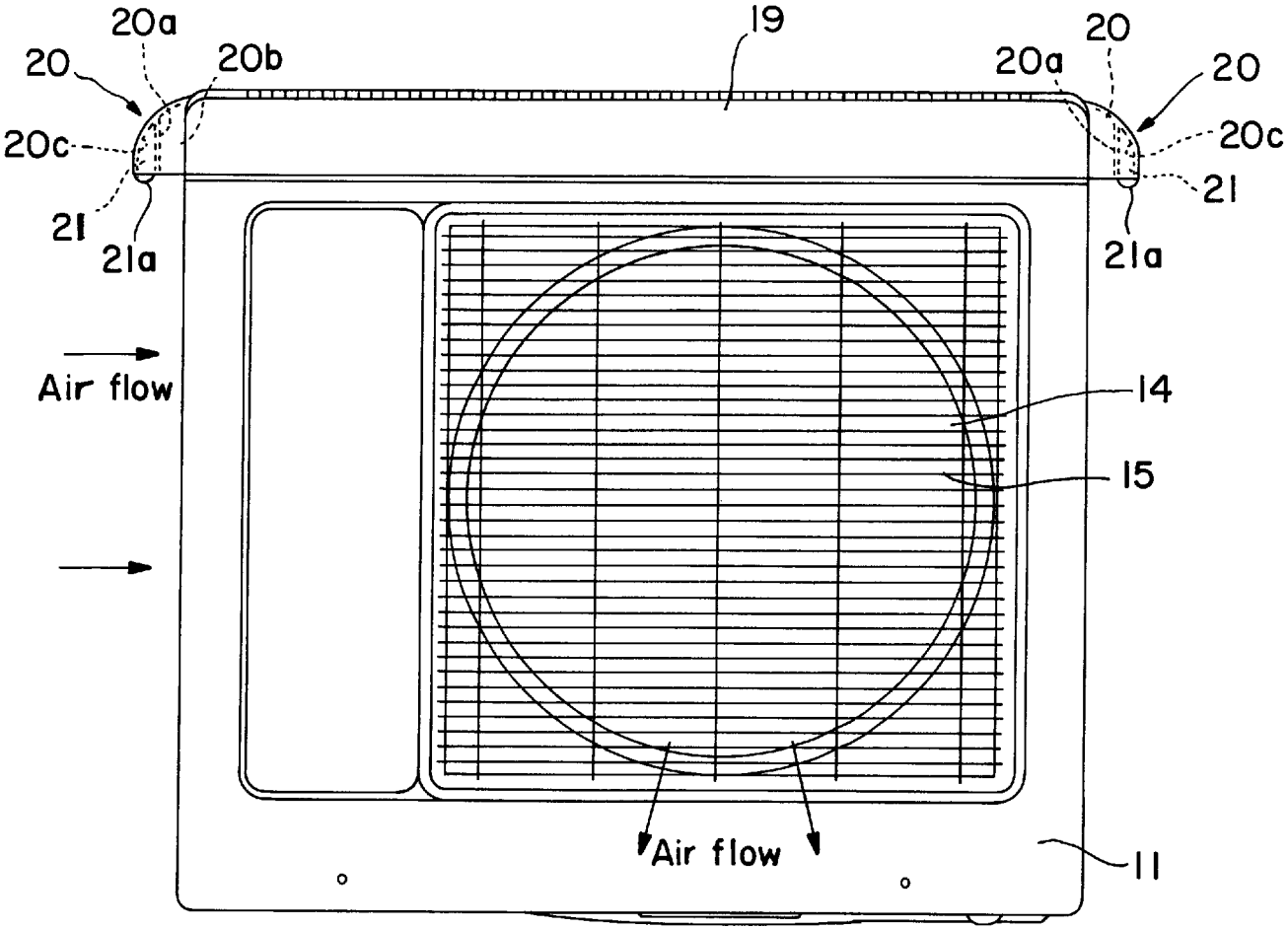
FIG. 1 is a front view of an outdoor unit for explaining a first embodiment of the invention.

The invention as set forth in claim 1 relates to an outdoor unit of separate type air conditioner comprising, inside of the outdoor unit main body, a wind circuit composed of an air suction port, a heat exchanger, a blower, and a air blow-out port, refrigeration cycle parts such as compressor and throttling device, and electric parts for composing an electric circuit, in which a ceiling cover is provided in the upper part of a housing of the outdoor unit, handles extending in the outer direction from the side of the outdoor unit housing are disposed at both side surfaces of this ceiling cover, and a space having a sufficient depth for allowing the fingers of a carrier to get in by about half of the length when conveying the outdoor unit main body is provided inside of the handle. In this constitution, the handles are formed so as to extend in the outer direction from the side of the outdoor unit housing, and therefore the degree of freedom of design of the handles is assured without having effects on the internal structure of the outdoor unit. Besides, as the structure of the handle main body, since a space for applying up to the second joint of the finger is assured when conveying the outdoor unit, it is easier to convey the outdoor unit.

The invention as set forth in claim 2 relates to an outdoor unit of separate type air conditioner comprising, inside of the outdoor unit main body, a wind circuit composed of an air suction port, a heat exchanger, a blower, and a air blow-out port, refrigeration cycle parts such as compressor and throttling device, and electric parts for composing an electric circuit, in which a ceiling cover is provided in the upper part of a housing of the outdoor unit, handles extending in the outer direction from the side of the outdoor unit housing are disposed at both side surfaces of this ceiling cover, a first space having a sufficient depth for allowing the fingers of a carrier to get in by about half of the length when conveying the outdoor unit main body, and a second space having plural ribs for lessening the pressure load to the fingers and reinforcing the handle are provided inside of the handle, and the ribs have a proper angle for the ease of gripping. In this constitution, the structure of the handle has a degree of freedom of design. The constitution of the handle main body is a double structure having the first space and the second space. Moreover, owing to the presence of the ribs, it is intended to keep a space for applying up to the second joint of the finger when conveying the outdoor unit, prevent load and damage to the fingers of the hand, and keep strength of the handle. Still more, since the ribs have a certain angle for the ease of holding, it is further easier to convey the outdoor unit.

The invention as set forth in claim 3 relates to claim 1 or 2, in which a penetration hole for penetrating a rope or the like is provided in the handles. In this constitution, a rope can be used by passing through the penetration hole, and the outdoor unit can be conveyed and installed more easily by using the rope.

The invention as set forth in claim 4 relates to claim 1 or 2, in which the lower side of the handles has a specific angle to the horizontal surface. In this constitution, the angle formed between the handle and the hand is an easy-to-grip angle, and the outdoor unit can be conveyed and installed easily.

The invention as set forth in claim 5 relates to claim 1 or 2, in which the lower side of the handles is formed with a specific angle to the horizontal surface, and a penetration hole for penetrating a rope or the like is further provided in part. In this constitution, the conveying method and installing method of the outdoor unit can be properly selected depending on the circumstances.

Referring now to the drawings, embodiments of the invention are described below.

Figure 2:
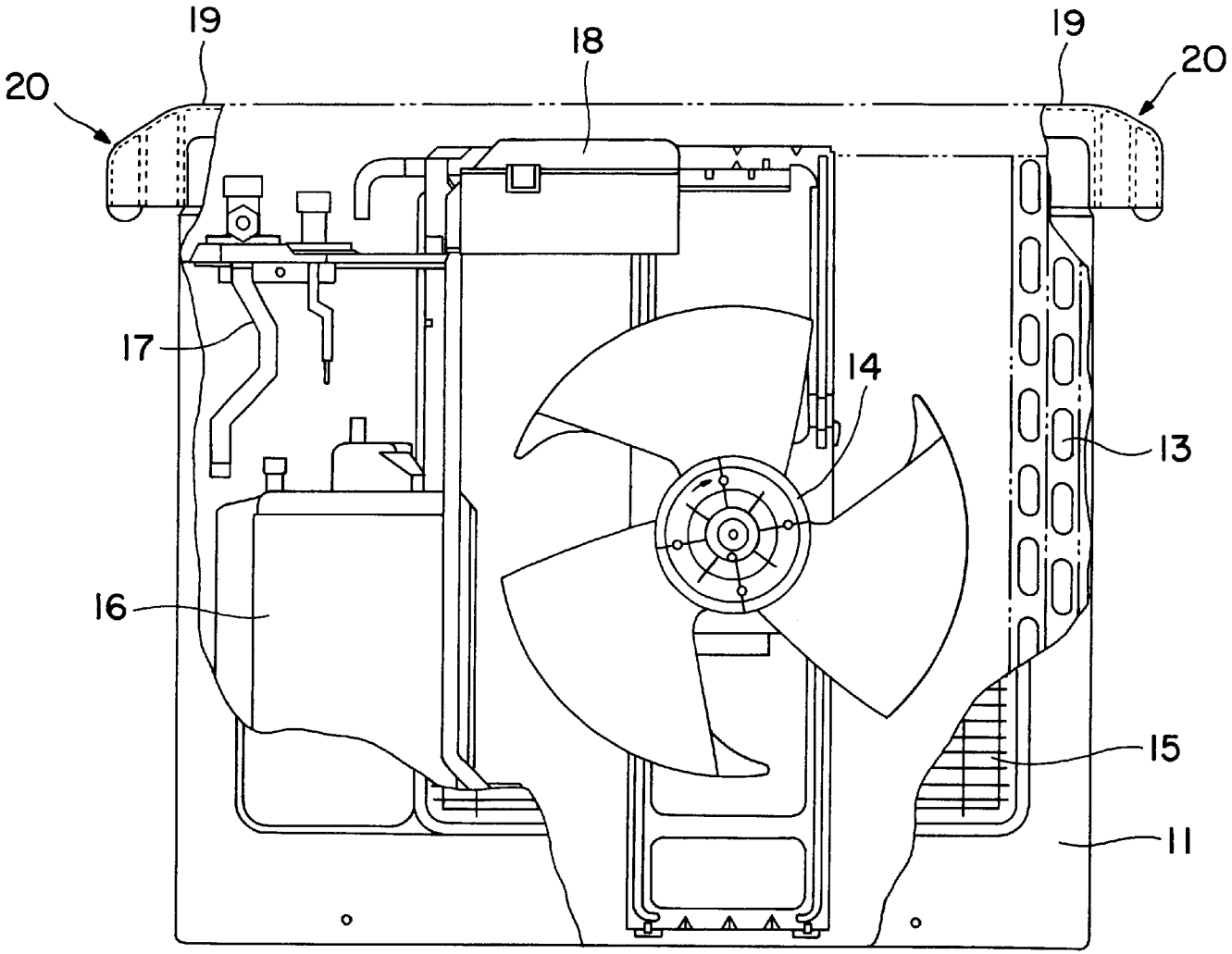
FIG. 2 is a front partial sectional view showing essential parts of the outdoor unit of FIG. 1.
Figure 4:
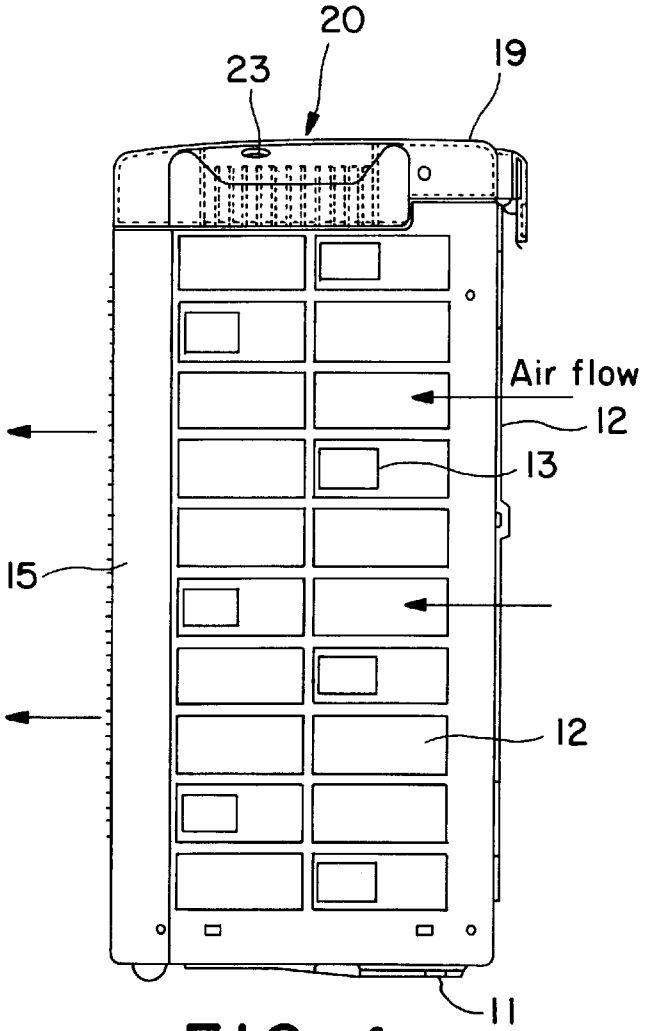
FIG. 4 is a side partial sectional view showing essential parts of the outdoor unit of FIG. 1.
Figure 3:
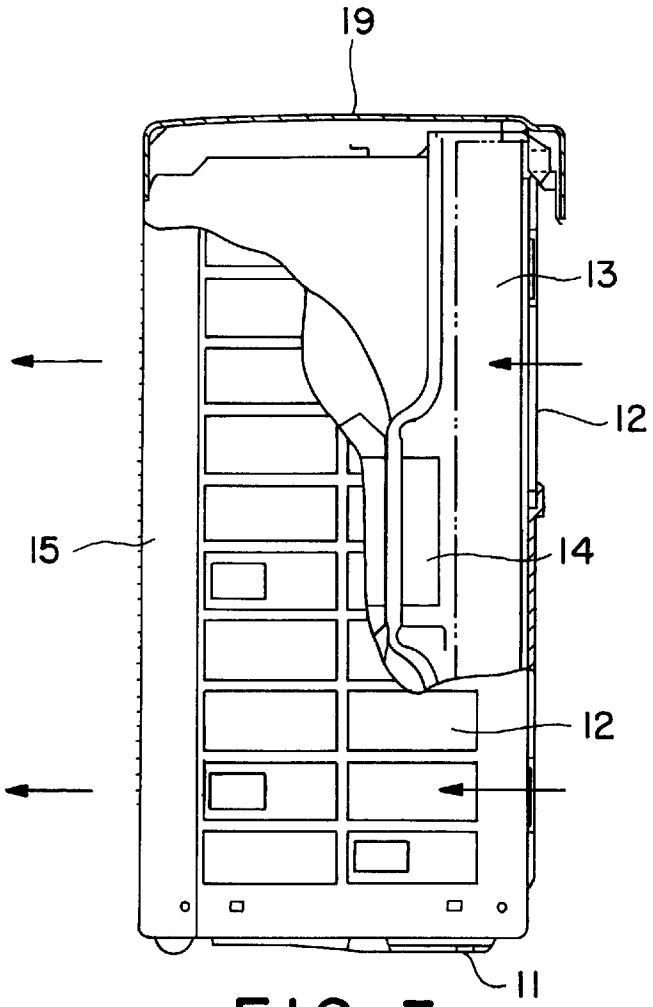
FIG. 3 is a side view of the outdoor unit of FIG. 1.
Figure 5:
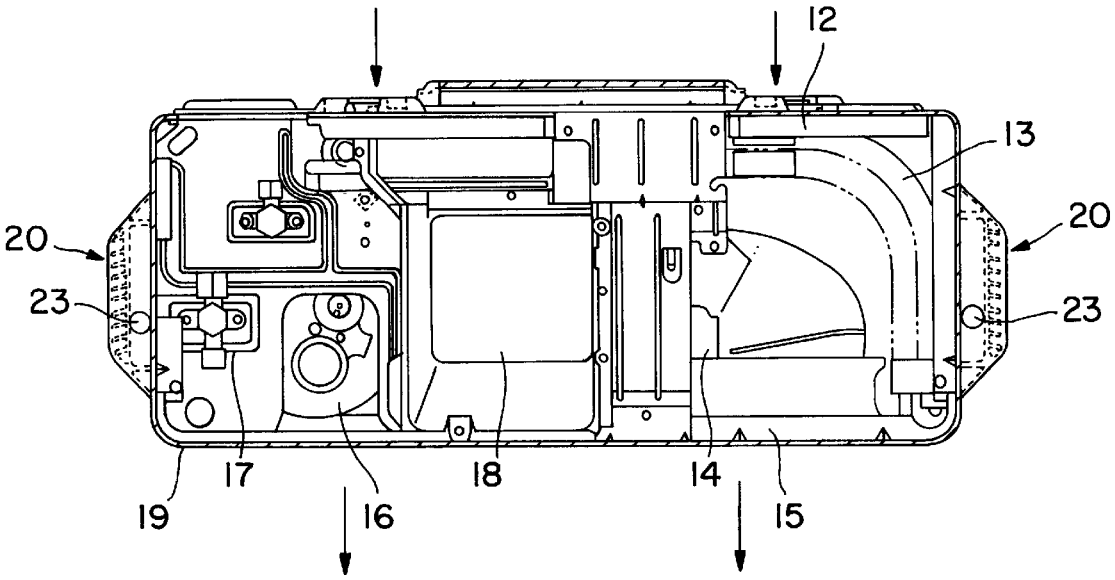
FIG. 5 is a plan partial sectional view showing essential parts of the outdoor unit of FIG. 1.

FIG. 1 is a front view of an outdoor unit for explaining a first embodiment of the invention, FIG. 2 is a front partial sectional view showing essential parts of the outdoor unit of FIG. 1, FIG. 3 is a side view of the outdoor unit of FIG. 1, FIG. 4 is a side partial sectional view showing essential parts of the outdoor unit of FIG. 1, and FIG. 5 is a plan partial sectional view of the outdoor unit of FIG. 1. Reference numeral 11 is an outdoor unit main body of separate type air conditioner, and the outdoor unit main body 11 incorporates a wind circuit composed of an air suction port 12, a heat exchanger 13, a blower 14, and an air blow-out port 15, refrigeration cycle parts 17 such as compressor 16 and throttling device, and a power source box 18 containing electric parts for composing an electric circuit. Above the housing of the outdoor unit main body 11, a ceiling cover 19 for forming a part of the housing box is provided, and handles 20 extended in the outer direction from the sides of the housing of the outdoor unit main body 11 are provided at both side surfaces of this ceiling cover 19.

Figure 6:
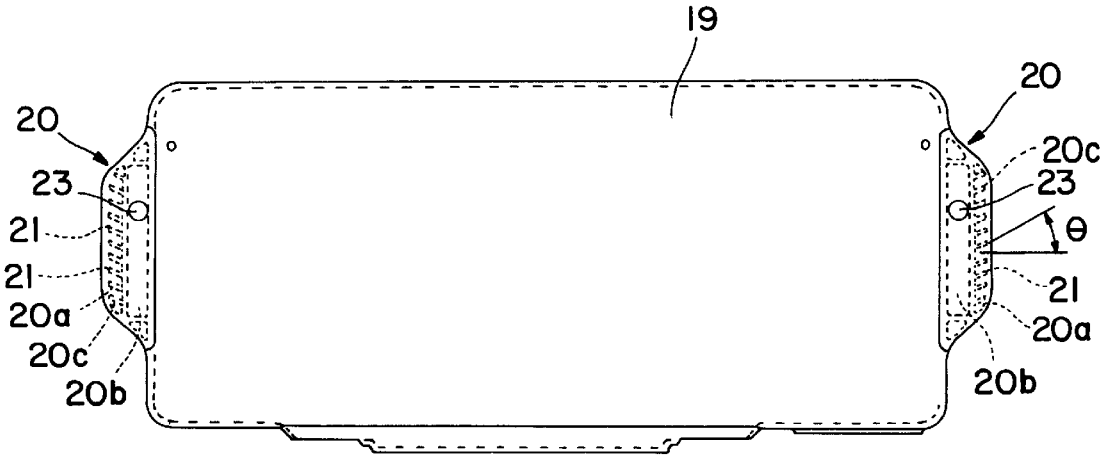
FIG. 6 is a plan view of a ceiling cover in the embodiment.
Figure 7:
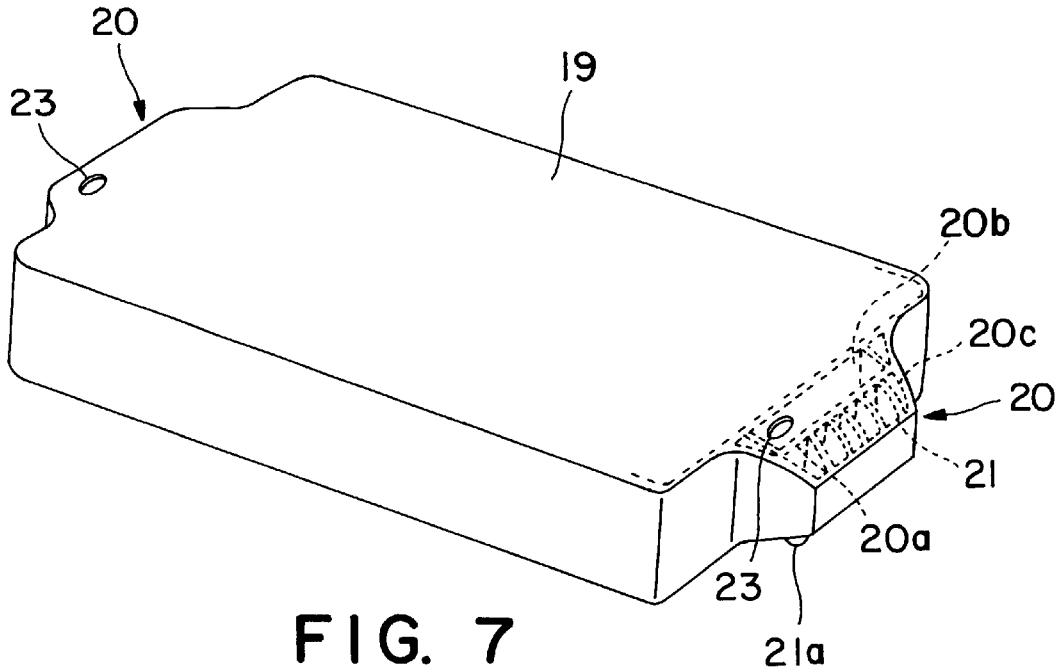
FIG. 7 is a perspective view showing a ceiling cover in the embodiment.
Figure 8:
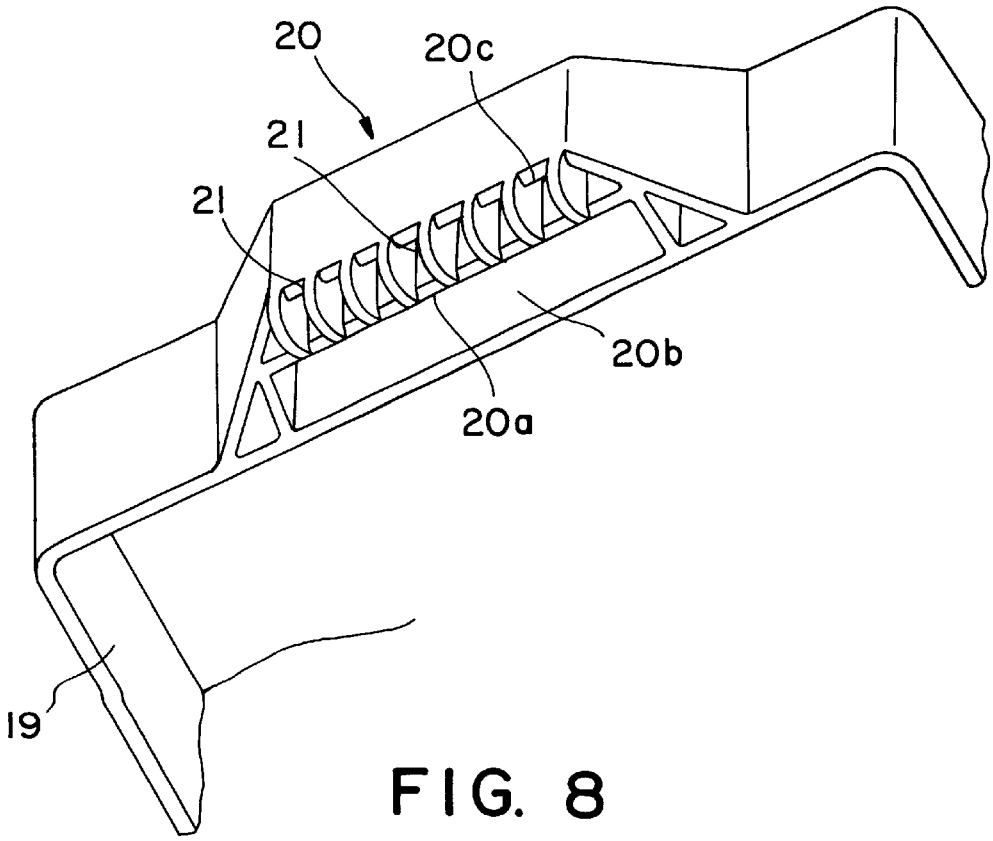
FIG. 8 is a perspective view showing one side of the ceiling cover in the embodiment from the bottom side.
Figure 9:
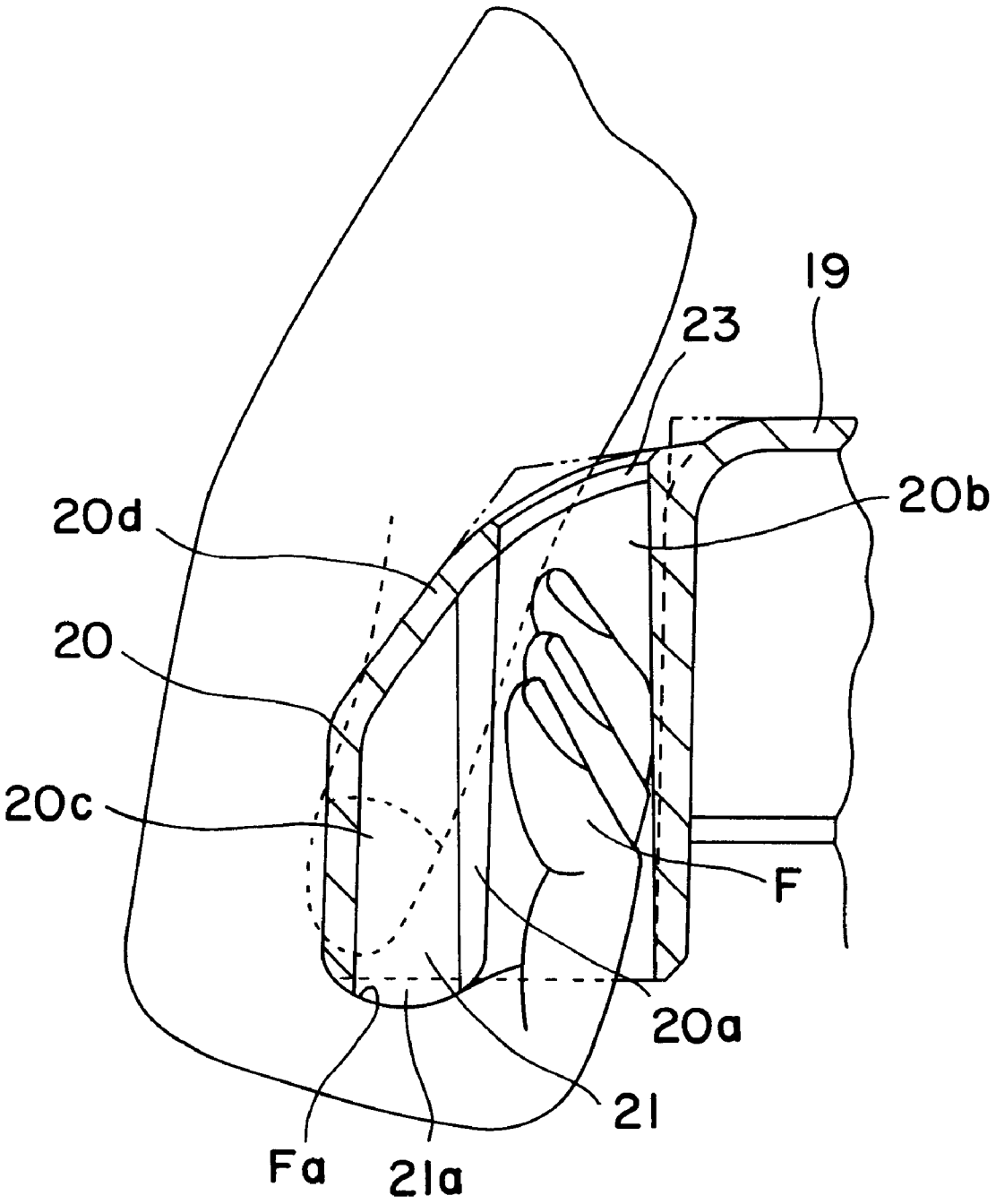
FIG. 9 is a magnified sectional view in one side of the ceiling cover in the embodiment.

FIG. 6 is a plan view of the ceiling cover, and FIG. 7 is a perspective view of the ceiling cover, and at both sides of the ceiling cover 19, the handles 20 formed integrally with the main body of the ceiling cover 19 and extended in the outer direction are provided. FIG. 8 is a perspective view showing one side of the ceiling cover from the bottom side, and FIG. 9 is a magnified sectional view in one side of the ceiling cover. The inside of the handle 20 is a double structure consisting of right and left spaces in an approximately m-shaped longitudinal section by means of a partition wall 20*a*. A first space 20*b* is a space for inserting the finger F of the carrier when conveying the outdoor unit main body 11, and an enough space for inserting the finger F sufficiently up to the second joint is provided. In a second space 20*c*, plural ribs 21 are disposed at specific intervals, and the leading end 21*a* of each rib 21 is formed in a semicircular form so that the finger F may settle in naturally, and has a specific angle θ.

Thus, in the outdoor unit main body 11, the inside of the handles 20 disposed at both side surfaces of the ceiling cover 19 and extended in the outer direction is formed in a double structure of nearly m-shaped longitudinal section by the partition wall 20*a*. The space 20*b* allowing the finger of the carrier to be inserted to the second joint, and plural ribs 21 are disposed at specific intervals. Moreover, the leading end 21*a* of the rib 21 contacting with the finger F or palm Fa of hand is semicircular, and the leading end 21*a* of the rib 21 has a specific angle θ. In this constitution, when conveying the outdoor unit main body 11, the pressure load of the weight of the outdoor unit main body 1 applied on the finger F of the carrier or damage can be lessened, and the strength of the handles 20 is also assured. As a result, the outdoor unit main body 1 can be conveyed easily.

Figure 10:
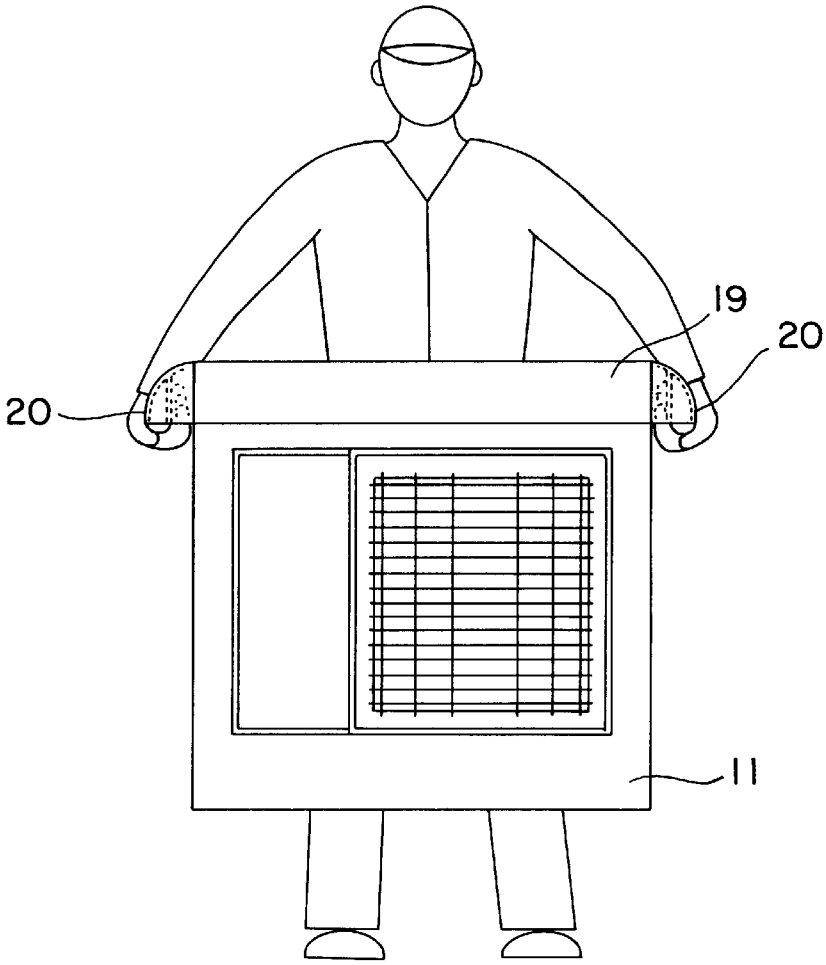
FIG. 10 is an explanatory diagram showing the method and state of conveying the outdoor unit main body actually by using handles in the embodiment.

FIG. 10 is an explanatory diagram showing the method and state of conveying the outdoor unit main body 11 actually by using the handles 20.

The ceiling cover 19 can be manufactured by using synthetic resin. The ceiling cover 19 and handles 20 can be formed integrally. As shown in a perspective view in FIG. 11 and a sectional view in FIG. 12 along line A—A in FIG. 11, the same effects as shown above are obtained by forming handles 30 by extending in the outer direction integrally with a metal ceiling cover 29 made of galvanized plate or the like, and folding the leading end 30*a* of the handles 30 contacting with the finger or palm of hand of a man in an arc form.

Figure 13:
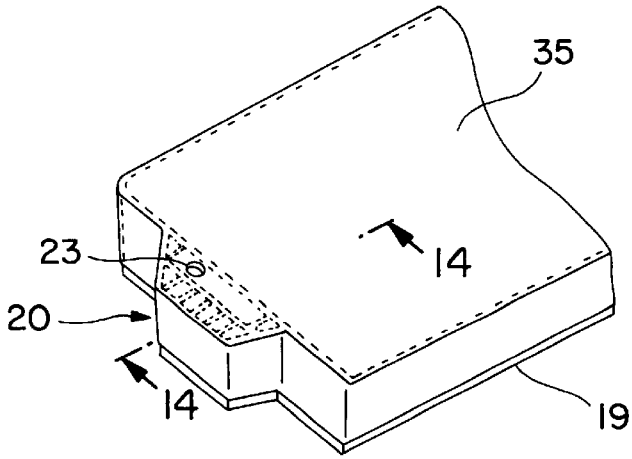
FIG. 13 is a perspective view showing a part of essential parts of an outdoor unit for explaining a second embodiment of the invention.
Figure 14:
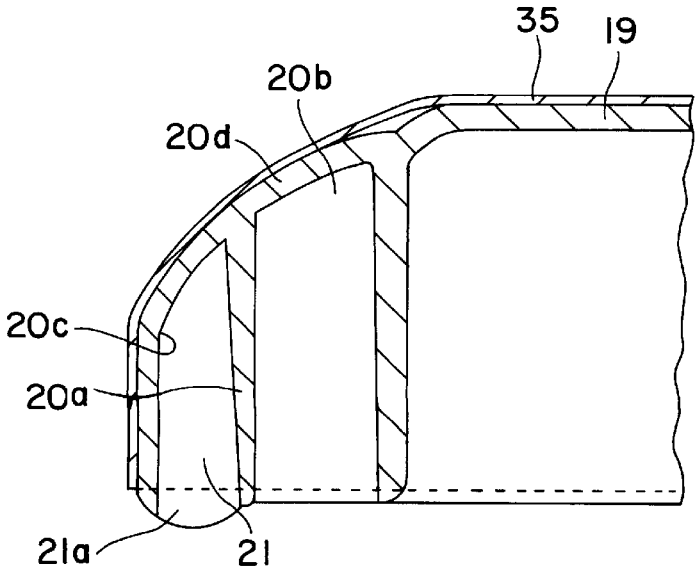
FIG. 14 is a sectional view along line A—A magnifying essential parts in FIG. 13.

FIG. 13 is a perspective view showing a part of essential parts of an outdoor unit for explaining a second embodiment of the invention, and FIG. 14 is a sectional view along line A—A magnifying essential parts in FIG. 13. Same as in the foregoing embodiment, the ceiling cover 19 formed of synthetic resin, and a metal cover 35 of galvanized plate or the like for covering the outer surface of the handles 20 are disposed. In this constitution, same effects as above are obtained, and further the synthetic resin-made ceiling cover 19 and handles 20 are protected from outdoor exposure, and deterioration of synthetic resin can be suppressed.

Figure 15:
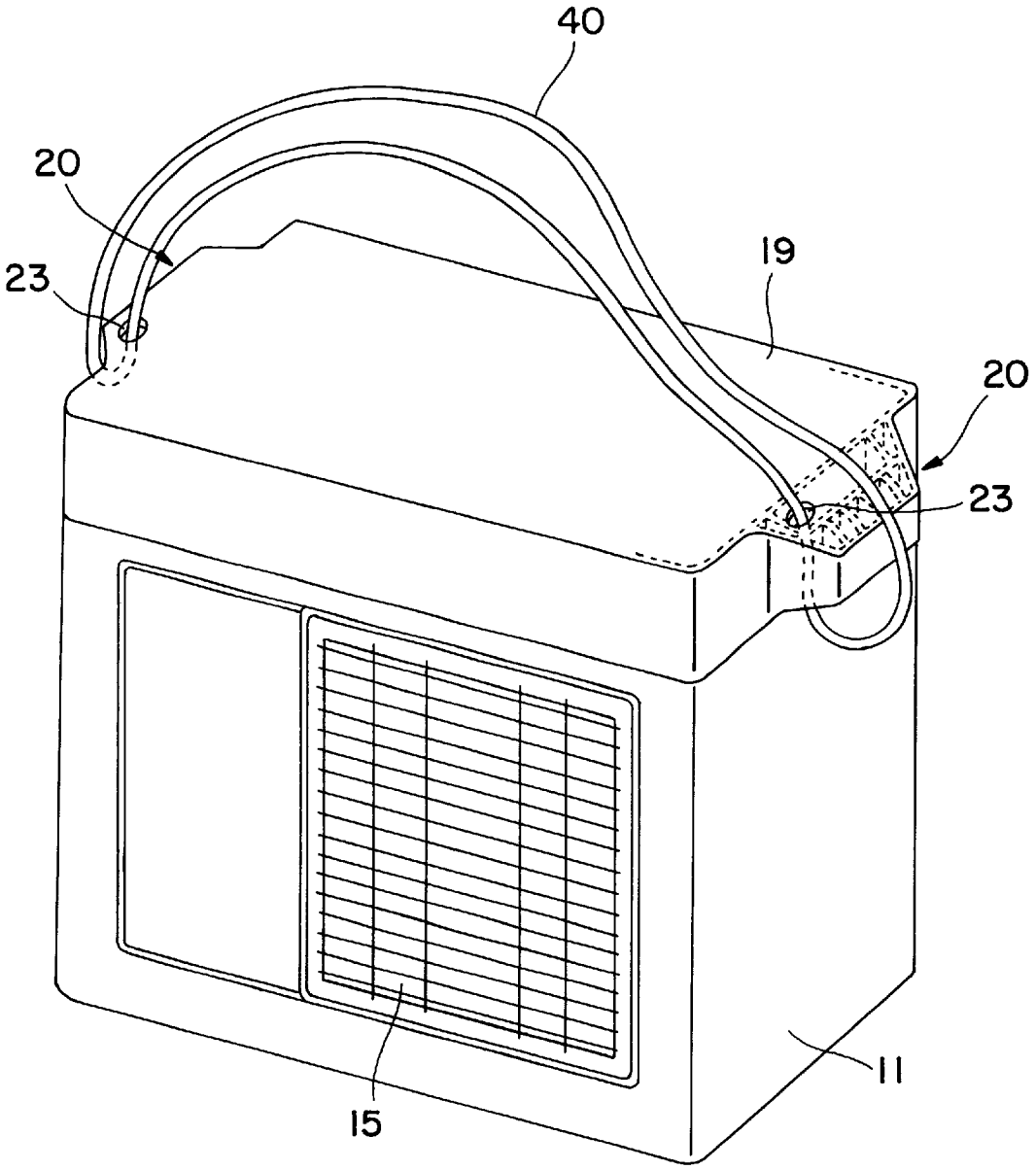
FIG. 15 is a perspective view showing an example of using a rope in the embodiment.

In the outdoor unit of these embodiments, a penetration hole 23 is provided in the wall 20*d* of the handle 20 extended in the outer direction integral with the ceiling cover 19. This penetration hole 23 is used by passing through a rope 40 or the like as shown in FIG. 15.

That is, by the penetration hole 23 provided in the wall 20*d* for integrating the handles 20 and ceiling cover 19, the rope 40 or other conveying tool can be utilized. By using the rope 40 or the like, the outdoor unit main body 11 may be more easily conveyed or installed in a specified place.

Figure 16:
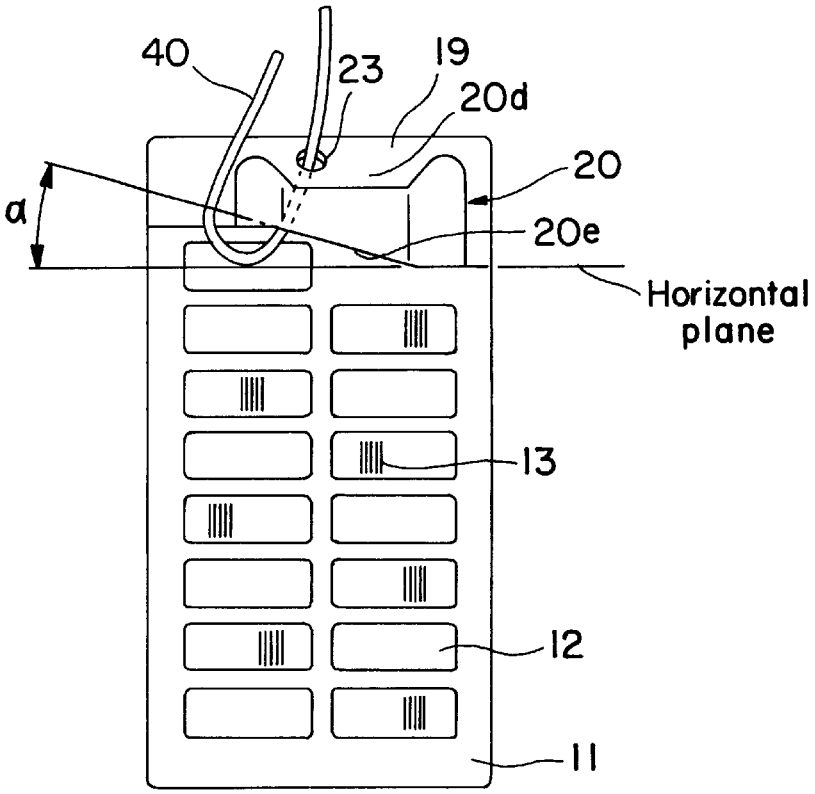
FIG. 16 is a side view of an outdoor unit for explaining a third embodiment of the invention.
Figure 17:
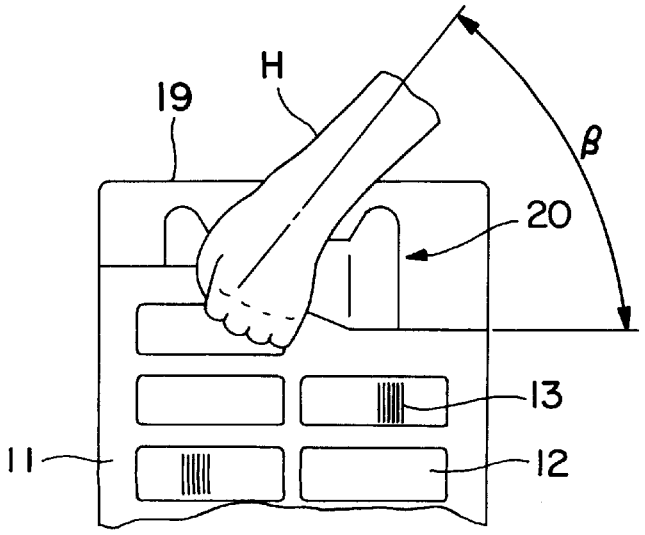
FIG. 17 is an explanatory diagram of conveying state of the outdoor unit of FIG. 16.
Figure 18:
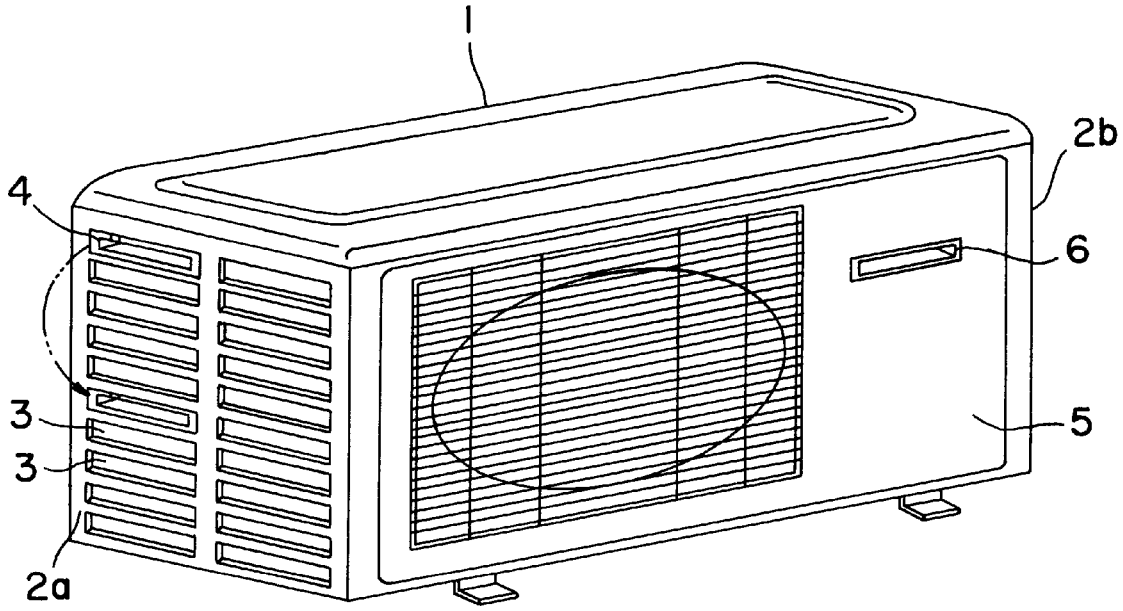
FIG. 18 is a perspective view showing a conventional outdoor unit.
Figure 19:
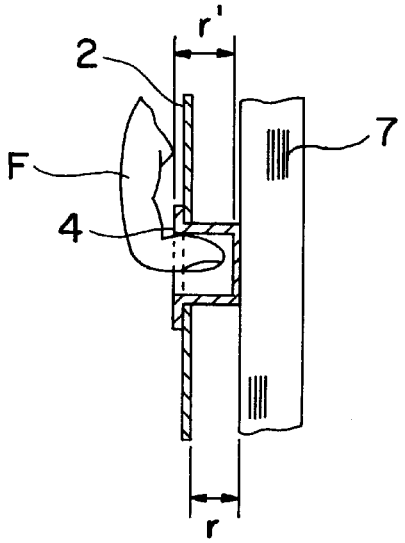
FIG. 19 is a sectional view showing essential parts in the outdoor unit of FIG. 18.

FIG. 16 is a side view of an outdoor unit for explaining a third embodiment of the invention, and FIG. 17 is an explanatory diagram of conveying state of the outdoor unit of FIG. 16, in which the lower side 20*e* of the handle 20 extended in the outer direction formed integrally with the ceiling cover 19 as described above is provided at an angle of $\alpha$ to the horizontal plane. In this constitution, when the carrier holds the handle 20, the angle $\beta$ of the hand H to the handle 20 is more acute than in the case without angle in the handle 20, and it is easier to apply force, so that the outdoor unit main body 11 may be conveyed more easily.

Further, in the outdoor unit in the third embodiment, a penetration hole 23 is provided in the handle 20 having the angle $\alpha$ to the horizontal plane at the lower side 20*e*, and the wall 20*d* as the coupling portion of the handle 20 and ceiling cover 19. In this constitution, in addition to the effect of forming the angle $\alpha$, the rope 40 or other conveying tool can be used, and the outdoor unit main body 11 can be conveyed more easily, and installed in a specified place more easily.

Figure 11:
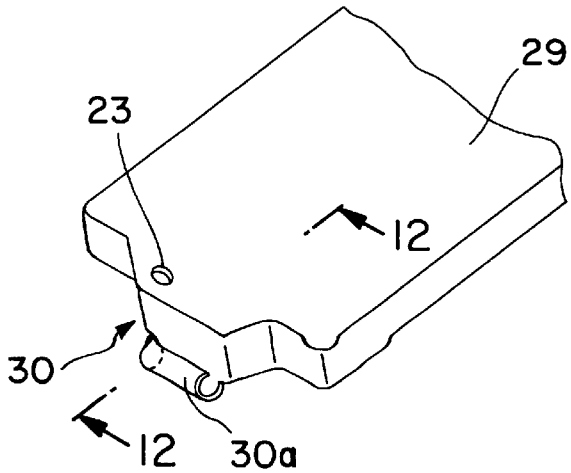
FIG. 11 is a perspective view showing a part of the ceiling cover made of metal such as galvanized plate.
Figure 12:
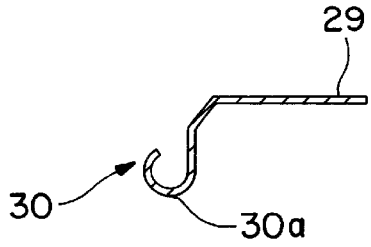
FIG. 12 is a sectional view of A—A of the ceiling cover in FIG. 11.

The structure of the handle 20 having the angle $\alpha$ to the horizontal plane explained in the third embodiment may be also applied to the handle 29 shown in FIG. 11 and FIG. 12.

INDUSTRIAL APPLICABILITY

As described herein, according to the outdoor unit of the separate type air conditioner of the invention, in the constitution not causing effects on the internal structure of the outdoor unit, a sufficient space is maintained so that the fingers of the carrier can be inserted deeply when conveying the outdoor unit, and hence it is easy to convey, which is a very realistic and practical effect.

Moreover, ribs are provided for preventing load to the fingers of the hand, preventing damage, and keeping strength of the handles, and the ribs are formed at a specific angle for the ease of gripping, and therefore the load to the hand and fingers when the carrier conveys the outdoor unit is lessened, so that it is easier to convey.

Also, a penetration hole for inserting a rope or the like is provided, and therefore the rope or the like can be utilized when conveying or installing the outdoor unit. As a result of increase in the number of conveying means of the outdoor unit, the best conveying method suited to the situation can be selected, and it is easier to convey by selection of a proper one.

By forming a specific angle to the horizontal plane at the lower side of the handle, the angle of the hand to the handle is acute when the carrier grips the handle, and it is easy to apply force, so that the outdoor unit may be conveyed further easily.

Further, by forming a specific angle to the horizontal plane at the lower side of the handle, and disposing a penetration hole in the handle for inserting a rope or the like, the rope or the like ca be utilized when conveying or installing the outdoor unit, and as a result of increase in the number of conveying means of the outdoor unit, and by selecting the best conveying method suited to the situation, it is effective to convey appropriately and more easily.

What is claimed is:

1. A separate type air conditioner unit suitable for conveying by a carrier, comprising:

a wind circuit including an air suction port, a heat exchanger, a blower, and a air blow-out port, refrigeration cycle means including a compressor and a throttling device, and a ceiling cover provided in an upper part of said unit, handles extending in the outer direction from the sides of said unit and disposed at both side surfaces of said ceiling cover, said handles defining a space having a sufficient depth for allowing the fingers of said carrier to get in when conveying the unit.

2. An outdoor unit of separate type air conditioner of claim 1, wherein a penetration hole for penetrating a rope like member is provided in said handles.

3. A separate type air conditioner unit suitable for conveying by carrier, comprising:

wind circuit including an air suction port, a heat exchanger, a blower, and a air blow-out port, refrigeration cycle means including a compressor and throttling device, and a ceiling cover provided in an upper part of said unit, handles extending in the outer direction from the sides of said unit and disposed at both side surfaces of this ceiling cover, said handles defining a first space having a sufficient depth for allowing the fingers of said carrier to get in when conveying the unit, and a second space having plural ribs for lessening the pressure load to the fingers and reinforcing the handle.

4. A separate type air conditioner unit suitable for conveying by a carrier and comprising:

(a) a box having a top plate, side plates, and a bottom plate, and (b) air conditioning function means disposed in said box, and including a compression device and a blower;

wherein said top plate has a handle projecting in outer direction from the outside of said side plates, the upper surface of said handle is formed consecutively to the upper surface of said top plate, and the lower surface of said handle has a space for fingers of said carrier to get in.

5. A separate type air conditioner unit of claim 4, wherein said space has a first space and a second space separated by a partition board parallel to said side surface, and said second space has a plurality of ribs for forming a plurality of third spaces arranged parallel longitudinally to said side surface.

6. A separate type air conditioner unit of claim 4, wherein said space has a first space and a second space separated by a partition board parallel to said side surface, said second space is formed at outer side of said first space, said second space has a plurality of ribs for forming a plurality of third spaces arranged parallel longitudinally to said side surface, and said handle has a lower surface at an inclination angle of $\alpha$ to the horizontal surface, so as to be gripped easily by said carrier.

7. A separate type air conditioner unit of claim 4, wherein said space has a first space and a second space separated by a partition board parallel to said side surface, said second space has a plurality of ribs for forming a plurality of third spaces arranged parallel longitudinally to said side surface, and the ends of said plurality of ribs have a semicircular shape so that a palm of said carrier may contact therewith as desired.

8. A separate type air conditioner unit of claim 4, wherein said space has a first space and a second space separated by a partition board parallel to said side surface, said second space has a plurality of ribs for forming a plurality of third spaces arranged parallel longitudinally to said side surface, and said plurality of ribs formed at an inclination angle of $\theta$ to the vertical direction of said side surface, so that a plurality of fingers of said carrier may settle in a desired direction.

9. A separate type air conditioner unit of claim 4, wherein said handle has a through-hole for penetrating a rope.

10. A separate type air conditioner unit of claim 4, wherein said handle has a lower surface at an inclination angle of $\alpha$ to a horizontal surface, so as to be gripped easily by said carrier.

11. A separate type air conditioner unit of claim 4, further comprising:

a metal cover for covering the top plate having said handle.

12. A separate type air conditioner unit of claim 4, wherein said handle has a lower surface at an inclination angle of $\alpha$ to a horizontal surface, and said handle has a through-hole for penetrating a rope.

13. A separate type air conditioner unit of claim 4, wherein the side surface of said handle has a end portion bent in an arc form.

14. A separate type air conditioner unit of claim 4, wherein said top plate having said handle is formed integrally of resin.

15. A separate type air conditioner unit of claim 4, further comprising:

a metal cover for covering the top plate having said handle, and the side surface of said handle having said metal cover has a end portion bent in an arc form together with said metal cover.

16. A separate type air conditioner unit of claim 4, further comprising:

a metal cover for covering the top plate having said handle, said top plate having said handle is formed integrally of resin, and the side surface of said handle having said metal cover has a end portion bent in an arc form together with said metal cover.

17. A separate type air conditioner unit of claim 4, wherein said space has a first space and a second space separated by a partition board parallel to said side surface, said second space is formed at outer side of said first space, said second space has a plurality of ribs for forming a plurality of third spaces arranged parallel longitudinally to said side surface, said handle has a lower surface inclined by an angle $\alpha$ to the horizontal surface, so as to be gripped easily by said carrier, the ends of said plurality of ribs have a semicircular shape, and said plurality of ribs are formed at an inclination angle of $\theta$ to the vertical direction of said side surface.

* * * * *

UNITED STATES PATENT AND TRADEMARK OFFICE

CERTIFICATE OF CORRECTION

PATENT NO. : 6,044,657
DATED : April 4, 2000
INVENTOR(S) : Mitsuo Nakanuma, Koji Hatano It is certified that error appears in the above-identified patent and that said Letters Patent is hereby corrected as shown below:

Cover page, item [73] list Assignee --Matsushita Electric Industrial Co., Ltd.--.

Column 6, line 34, insert --a--before "wind".

Signed and Sealed this

Twelfth Day of June, 2001

Nicholas P. Godici

*Attest:*

*Attesting Officer*

NICHOLAS P. GODICI
*Acting Director of the United States Patent and Trademark Office*